US007647805B2

(12) United States Patent
Yamamoto

(10) Patent No.: US 7,647,805 B2
(45) Date of Patent: Jan. 19, 2010

(54) PRECISION DESORBING (DETACHABLE) METAL SHEET BEND ANGLE ADJUSTMENT DEVICE

(76) Inventor: Takahisa Yamamoto, 1-27-1-701, Higashikashiwagaya, Ebina City, Kanagawa (JP)

( * ) Notice: Subject to any disclaimer, the term of this patent is extended or adjusted under 35 U.S.C. 154(b) by 534 days.

(21) Appl. No.: 10/574,609

(22) PCT Filed: Nov. 5, 2004

(86) PCT No.: PCT/JP2004/016806

§ 371 (c)(1),
(2), (4) Date: Apr. 5, 2006

(87) PCT Pub. No.: WO2005/044479

PCT Pub. Date: May 19, 2005

(65) Prior Publication Data

US 2007/0074555 A1 Apr. 5, 2007

(30) Foreign Application Priority Data

Nov. 10, 2003 (JP) ..... 2003-380119

(51) Int. Cl.
*B21D 5/02* (2006.01)

(52) U.S. Cl. ..... 72/389.4; 72/389.5; 72/448

(58) Field of Classification Search ..... 72/389.4, 72/389.5, 446, 448
See application file for complete search history.

(56) References Cited

U.S. PATENT DOCUMENTS 2,199,864 A * 5/1940 Wehr ..... 72/448
3,480,445 A 11/1969 Slaybaugh
3,615,675 A 10/1971 Wisdom et al.

(Continued)

FOREIGN PATENT DOCUMENTS

JP 60-047017 B 10/1985

(Continued)

OTHER PUBLICATIONS

International Search Report, from corresponding PCT Publication No. WO 2005/044479, dated Dec. 14, 2004, 2 pages.

*Primary Examiner*—David B Jones
(74) *Attorney, Agent, or Firm*—Pauly, Devries Smith & Deffner, L.L.C.

(57) ABSTRACT

A precision metal sheet bend angle adjustment device is provided, which includes a lifter plate, a wedge plate, a support plate and a positioning frame. The lifter plate has a tapered bottom face. The wedge plate has a tapered top face and side recesses. The support plate has a top guiding grove and the positioning frame includes a rotary dial and adjustment screw. The support plate is fixed on the positioning frame. The wedge plate is located on top of the assembly such that it is able to slide within the guiding grove of the support plate. The adjustment screw of the rotary dial is inserted into the side recess of the wedge plate. The lifter plate rests on top of the wedge plate within the positioning frame such that, as the wedge plate slides back and forth, the lifter plate moves up and down within the positioning frame by rotating the rotary dial clockwise or counter clockwise. The die of the metal sheet bending equipment can be moved vertically while sitting atop the lifter plate.

7 Claims, 5 Drawing Sheets

U.S. PATENT DOCUMENTS 3,656,967 A 4/1972 Barton et al.
3,764,715 A 10/1973 Henthorn et al.
3,778,209 A 12/1973 Wallace et al.
3,922,353 A 11/1975 Bernotavicz
4,207,348 A 6/1980 Vermilyea et al.
4,426,873 A * 1/1984 Pearson et al. ..... 72/389.5
4,449,389 A * 5/1984 Cros ..... 72/389.5
4,517,203 A 5/1985 Levine et al.
4,721,622 A 1/1988 Kingham et al.
4,732,032 A 3/1988 Kogure
4,736,612 A * 4/1988 Russell ..... 72/389.5
4,882,185 A 11/1989 Simelunas et al.
4,898,015 A * 2/1990 Houston ..... 72/446
5,103,665 A 4/1992 van Merksteijn
6,406,731 B1 6/2002 Hartman

FOREIGN PATENT DOCUMENTS

JP 61-129226 A 6/1986
JP 62-224426 10/1987

* cited by examiner

PRECISION DESORBING (DETACHABLE) METAL SHEET BEND ANGLE ADJUSTMENT DEVICE

CROSS-REFERENCE TO RELATED APPLICATIONS

This application is a national stage application under 35 U.S.C. 371 of International Patent Application Serial No.: PCT/JP2004/016806, entitled "Detachable Type Metal Plate Bending Angle Accuracy Adjusting Device," filed Nov. 5, 2004, which claims priority to Japanese Patent Application No.: JP20030380119, filed Nov. 10, 2003.

FIELD OF THE INVENTION

This invention is about a device that adjusts bend angle of metal sheets precisely and is desorbed with ease. Especially, this precision metal sheet bend angle adjustment device is designed to be mounted and desorbed quite easily to and from the metal sheet bending equipment that is without a metal sheet bend angle adjusting mechanisms.

DESCRIPTION OF RELATED ART

As shown in FIG. 1, with usual metal sheet bending machines, the metal sheet (2) rests on V-shaped die (1), then the sheet (2) is processed into V-shape by the downward thrust of punch (press) (3) onto the metal sheet (2). During this process, if downward thrust and pressure of the punch (press) (3) is inadequate, the bend of the sheet may be less than expected angle producing defective product. Furthermore, because of the uniform thickness or quality of the metal sheets, as well as uneven pressure from the punch (press), cause the bend of the sheet to have the distortion as saddle dip, drooping in the middle section or rippling producing defective products.

Formerly, complex structured precision metal sheet bend angle adjustment device was built into the whole equipment as the solutions to the issues mentioned above. This approach increased both the cost of the equipment and the complexity of the operation. Some of the simpler solutions utilized intervention using such item as news paper—inserted at the suspected location of the die, which caused the defects, to adjust the height of the die to attain the expectant angle of the metal sheet bend to avoid the droop in the middle section, saddle dips and warps.

However, solutions such as inserting newspaper to stabilize the height of die accurately to produce desired bent angle of metal sheet is fundamentally extremely difficult task, relying on the adjuster's experience and intuition. This kind of solution does not provide reliable production environment where anyone can easily adjust the machine to produce highly accurate metal sheet bend angle. Usually, highly repetitive "trial and error" approach is used and as the result, the number of the manufactured faulty parts or defective products increases which in turn drives the whole manufacturing cost upward.

Also, inserting the items such as newspaper under the dies for adjustments requires that the die have to be removed each time the adjustment is made. This decreases the productivity of the bending process. Other disadvantage of this kind of adjustment is that the papers may be too thick for accurate adjustment to produce desired products and, furthermore, inserted papers deteriorate slowly but surely, making it difficult to ensure the accurate reproducibility of the "metal to metal" contact for the accurate metal sheet bending.

The issue this invention addresses and provides solution is to increase the tolerance of the metal sheet bending by providing installation of detachable metal sheet bend angle adjusting mechanism that is simple and easy to adjust yet offers accurate and stable adjustment when problematic areas are found on the die during the bending process.

BRIEF SUMMARY OF THE INVENTION

This invention is about this precision metal sheet bend angle adjustment device, whose parts are the lifter plate, which has tapered face on the bottom, the wedge plate which has tapered face on top as well as recess on the sides, the support plate, furnished with a slot on top and a positioning frame that hosts a rotary dial with adjustment screw. The support plate is fixed on the positioning frame. The wedge plate is situated on top of the above assembly such that the wedge plate is able to slide on the support plate with the slot. The adjustment screw of the rotary dial is inserted to the recess of the wedge plate. The lifter plate sits on top of the wedge plate within the positioning frame such that as the wedge plate slides back and forth, the lifter plate moves up and down within the positioning frame by rotating the rotary dial clockwise or counter clockwise. The most important feature of the mechanism is that the die of the metal sheet bending equipment can be moved vertically sitting atop the lifter plate.

BRIEF DESCRIPTION OF SEVERAL VIEWS OF THE DRAWINGS

The Drawing No. 1 shows the metal sheet bend angle adjusting mechanism installed under V shaped die of a metal sheet bending equipment and how it typically looks.

The Drawing No. 2 shows the horizontal cross section view of the precision desorbing (detachable) metal sheet bend angle adjustment device.

Figure 1:
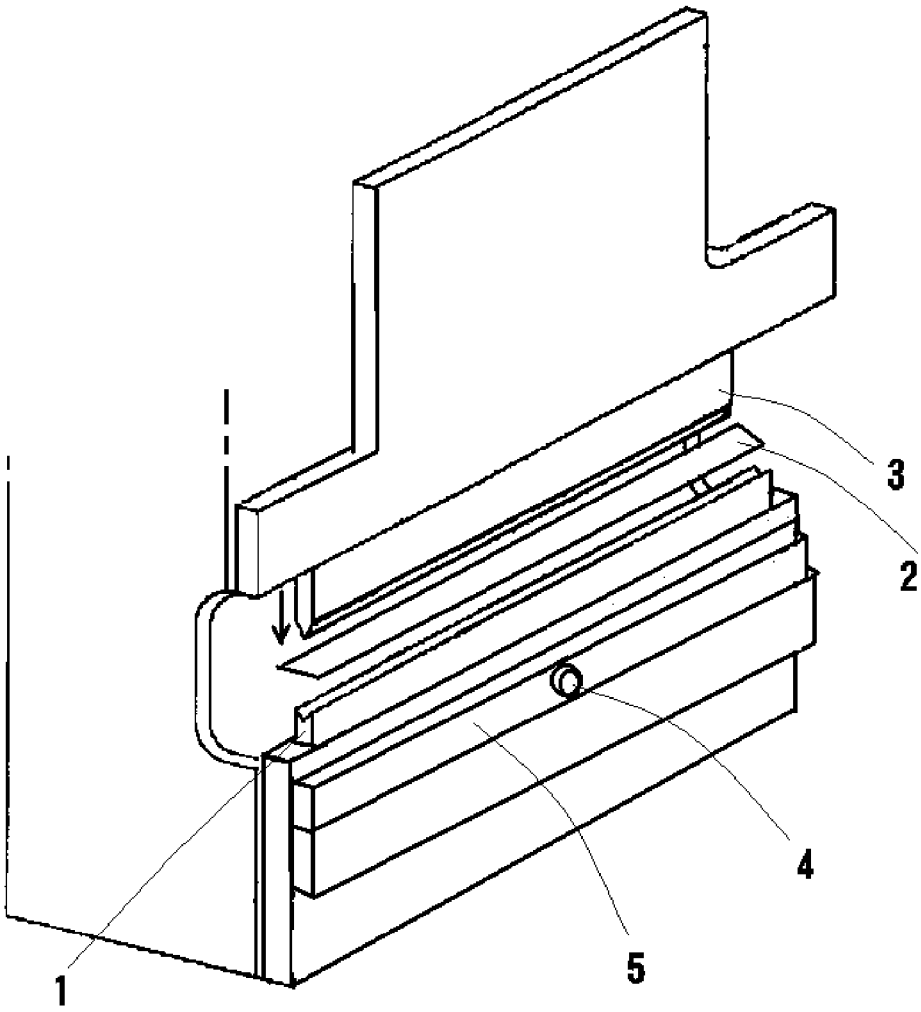
Figure 2:
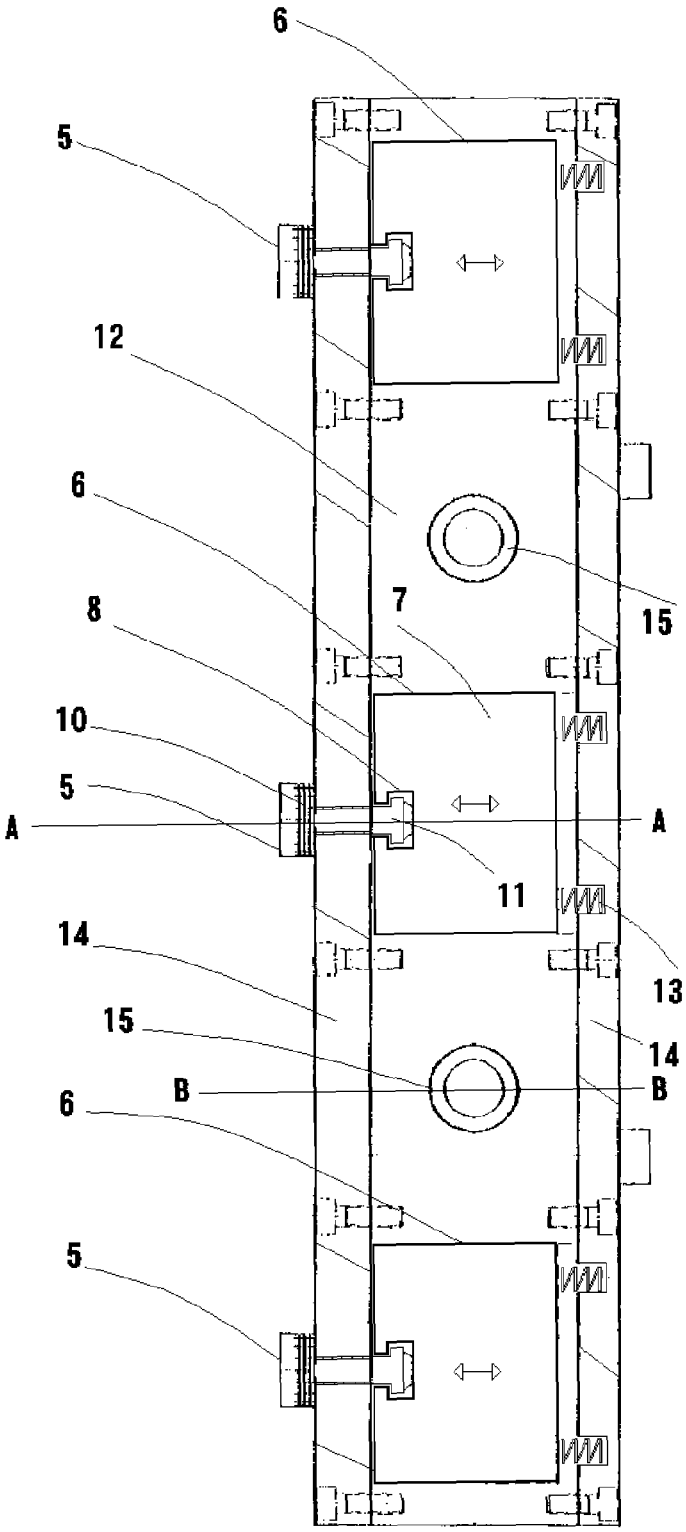
Figure 3:
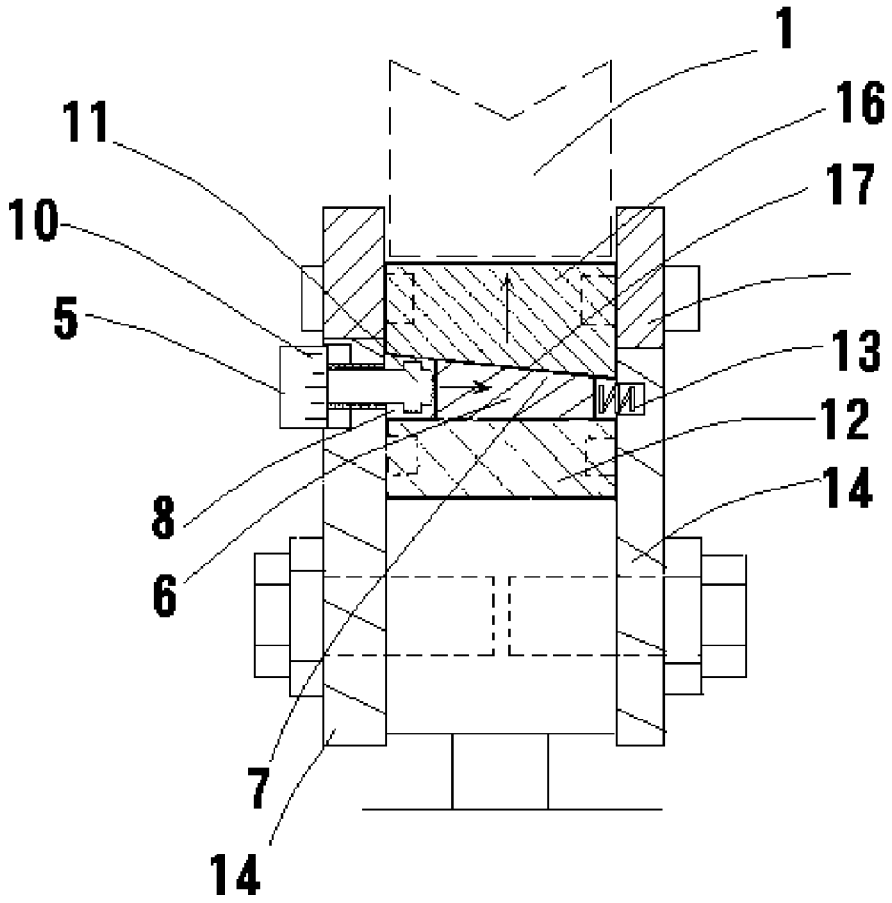
Figure 4:
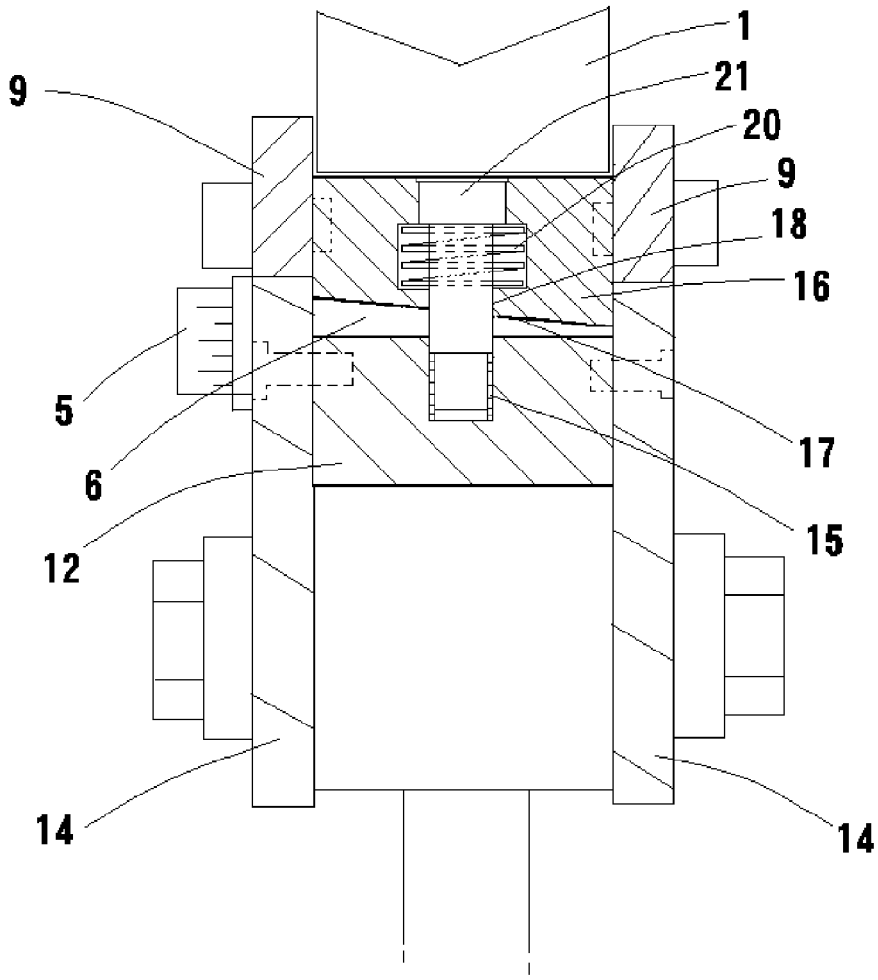
Figure 5:
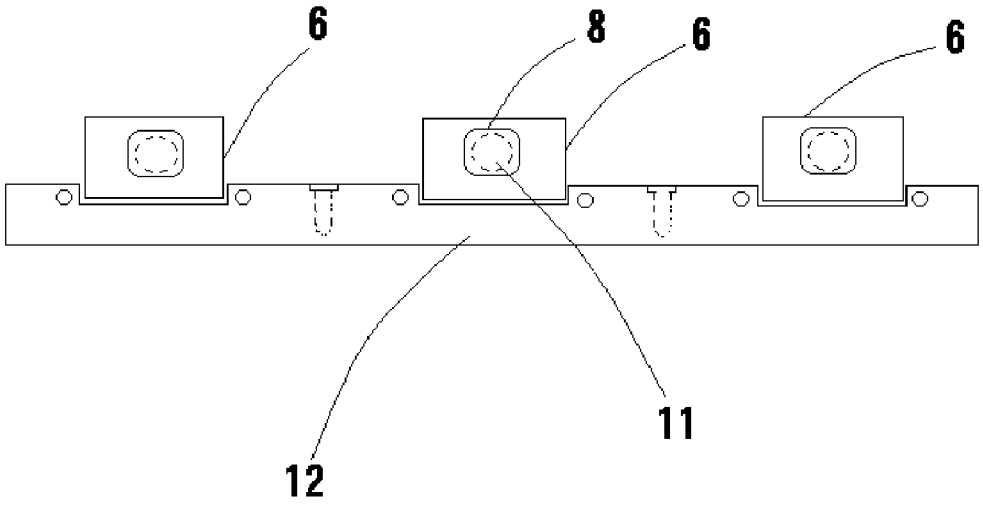

The Drawing No. 3 shows the cross section view of the drawing No. 2 along A-A plane.

The Drawing No. 4 shows the cross section view of the drawing No. 2 along B-B plane.

The Drawing No. 5 is a graphic of how the guide slot on the support plate of the metal sheet bending equipment is formed.

DETAILED DESCRIPTION OF THE INVENTION

As shown in the Drawing No. 1, for the metal sheet bending equipment which bends metal sheet (2) by putting the sheet on top of the V shaped die of the machine, and the pressure of the descending punch (press) (3), this invention offers advantage and powerful feature to be able to install the desorbing (detachable) metal sheet bend angle adjustment device (5) with adjustment screw of the rotary dial right underneath the V shaped die (1).

EXAMPLE 1

Drawing No. 2 shows the horizontal cross section view of the desorbing (detachable) metal sheet bend angle adjustment device (5). The wedge plate (6) is shown with the reverse taper face (7) and the side recess (8). The adjustment screw (11), which is attached to the upper positioning frame (9), of the rotary dial (10) is inserted to the recess (8) on the side of wedge plate (6). The wedge plate (6) slides back and forth atop the support plate (12) with a groove by rotating the rotary dial (10), which turns the adjusting screw. The pushing coil spring (13) operates as the wedge plate moves.

The drawing No. 3 shows the cross section of the drawing No. 2 on A-A plane. As mentioned above, the wedge plate (6) sits atop support plate (12), which is fixed to the lower positioning frame (14). The adjusting screw (13) of the rotary dial (10) is inserted into the recess (8) of the wedge plate that glides atop the supporting plate (12) as noted above. Then above the reverse taper face (7), fixed to the upper positioning frame (15) is the lifter plate (16) whose taper face sits on the wedge plate (6). The lifter plate moves up and down by the gliding action of the wedge plate (6).

Although the number of the assemblies of the wedge plate (6), rotary dial (10) and the adjustment screw (11) depends on the length and the width of the die (23) as well as the number of location of faulty bends, usually it should be somewhere from 3 to 10 on a die.

The drawing No. 4 shows the cross section of the drawing No. 2 on B-B plane. The lifter plate is prepared with a through hole (18) and a chamber half way of the through hole. After installing the ring spring (20) into the midway chamber, a bolt (21) is inserted through the ring spring (20) through the hole (20) to be further inserted into the screw hole (22) on the support plate (12). This is to reduce stress caused by the massive pressure on the die (23) during the bending metal sheet (2). The placement of the wedge plate (6) on the support plate (12) may include the formation of the guiding groove (slot) (24) to ensure the accurate gliding of the wedge plate (6). As shown in the drawing No. 2 and No. 3, the mechanism enabling the vertical movement of the lifter plate operates by the rotary dial (10), which is connected to the adjustment screw (11). When the rotary dial (10) is rotated clockwise, the adjustment screw (11) rotates with the dial (10). The tip of the adjustment screw (11) pushes the wedge plate forward against the spring (13). This forward movement of the wedge plate (11) lifts the taper face (17) of the lifter plate (16) by the reverse taper face (7). This lifts the die (23). Conversely, counter clockwise rotation of the rotary dial (10) rotates the adjustment screw (11). The tip of the adjustment screw (11) retracts when rotated counter clockwise. This makes the wedge plate (6) to move backward by the elasticity of the spring (13) causing the lifter plate (16) to lower by way of the reverse taper face (7) of the wedge plate (6) and the taper face (17) of the lifter plate (16). Finally, this lowers the die (23). When bending the metal sheet (2), if there is a concern about drooping of middle section or warping, raise the lifter plate (16) to move the die (23) upward and maintain the height of the die (23) by the operation mentioned above. If there is a concern about the acuteness of the bend or the drooping of the middle section, utilize the operation mentioned above to lower the lifter plate (16) to move the die (23) to prevent defects. Furthermore, if there is a concern about ripples at the bend, deploy multiple lifter plates (16) appropriately to either lower or raise the lifter plates to move the die to desired height to prevent defects.

The movement of the lifter plate (16) is to be less than that of the die (23) to prevent defects. Usually, the recommended range is 0.1 mm to 0.3 mm.

Also, the angles of reverse taper face (7) of the wedge plate (6) and the taper face (17) of the lifter plate (16), as well as the gliding range of the wedge plate (6) determine the range of the vertical movement of the lifter plate (16). Normally, angles of the tapered faces should be between 5 degrees to 10 degrees and the gliding range of the wedge plate should be 5 mm to 10 mm.

To precisely control the vertical movement of the lifter plate, for example, clockwise rotation of 360 degree can correspond to lifter plate (16) movement of somewhere within 0.1 mm to 10 mm as well as setting the graduated ruler marks appropriately corresponding to the rotation angle of the rotary dial (10). These settings can be adjusted so that the lifter plate (16) can be moved to the appropriate height to deal with the imperfection of the metal sheet.

Installing the Precision Desorbing (detachable) Metal Sheet Bend Angle Adjustment Device under the die of a metal sheet bending equipment offer many advantages.

Adjusting the die height with simple, easy and stable method to prevent malformed product plagued with less than desirable acute angle, middle section drooping, saddle dip or ripple is to ensure the accuracy of metal sheet bending process to output high quality bent metal sheet products. This also delivers reduction of manufacturing cost and increases the efficiency and the productivity of manufacturing.

This newly invented Precision Desorbing (detachable) Metal Sheet Bend Angle Adjustment Device can be installed to preexisting metal sheet bending equipment to improve the accuracy of the metal sheet bending process by providing simple, easy, accurate and stable means to adjust the die height of the areas of the die which may cause undesirable result because of faulty or imperfect material or adjustment during the metal sheet bending process. This makes manufacturing high quality bent metal products possible.

Also, this newly invented Precision Desorbing (detachable) Metal Sheet Bend Angle Adjustment Device can be used to adjust equipment that is long and narrow to a high accuracy of flatness, which can merit low maintenance for a long period.

The invention claimed is:

1. A detachable metal sheet bend angle adjustment assembly comprising:

a lifter plate having a tapered bottom face and a through hole with a middle chamber;

a wedge plate having a tapered top face, a bottom face, a front side face defining a side recess and a rear side face opposite the front side face, a support plate;

an upper positioning frame having a rotary dial with an adjustment screw, a pushing coil spring, and a ring spring installed within the middle chamber of the through hole in the lifter plate, wherein the bottom face of the wedge plate is slideably mounted to the support plate, such that the tapered top face of the wedge plate is in apposition to the tapered bottom face of the lifter plate and the side recess is configured to receive the adjusting screw of the upper positioning frame such that clockwise rotation of the adjusting screw advances the wedge plate and lifts the lifter plate and counterclockwise rotation of the adjusting screw in a second direction retracts the wedge plate and lowers the lifter plate, and wherein the pushing coil is configured to engage the rear side face of the wedge plate opposite the rotary dial such the elasticity of the pushing coil spring counterbalances the force generated by the rotation of the adjusting screw.

2. The detachable metal sheet bend angle adjustment assembly of claim 1, wherein the support plate is secured to the positioning frame.

3. The detachable metal sheet bend angle adjustment assembly of claim 1, wherein the lifter plate moves in a vertical direction with respect to the positioning frame and the wedge plate moves is a horizontal direction with respect to the positioning frame.

4. The detachable metal sheet bend angle adjustment assembly of claim 1, further comprising a ring spring disposed within a through hole bored through the lifter plate.

5. The detachable metal sheet bend angle adjustment assembly of claim 4, wherein a bolt secures the ring spring, which extends through the lifter plate to a threaded recess of the support plate.

6. The detachable metal sheet bend angle adjustment assembly of claim 1, further comprising graduated ruler marks corresponding to the rotation angle of the rotary dial.

7. The detachable metal sheet bend angle adjustment assembly of claim 6, wherein clockwise rotation of the rotary dial 360 degrees corresponds to lifter plate movement of between 0.1 mm to 10 mm.

* * * * *

UNITED STATES PATENT AND TRADEMARK OFFICE

CERTIFICATE OF CORRECTION

PATENT NO. : 7,647,805 B2
APPLICATION NO. : 10/574609
DATED : January 19, 2010
INVENTOR(S) : Takahisa Yamamoto It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 823 days.

Signed and Sealed this

Twenty-eighth Day of December, 2010

David J. Kappos

David J. Kappos
*Director of the United States Patent and Trademark Office*